US006921186B1

(12) United States Patent
Viskovich

(10) Patent No.: US 6,921,186 B1
(45) Date of Patent: Jul. 26, 2005

(54) DECORATIVE LIGHTING SYSTEM

(76) Inventor: Gayle A. Viskovich, 654 Francisco Ct., Walnut Creek, CA (US) 94598

( * ) Notice: Subject to any disclaimer, the term of this patent is extended or adjusted under 35 U.S.C. 154(b) by 76 days.

(21) Appl. No.: 10/640,072

(22) Filed: Aug. 13, 2003

(51) Int. Cl.[7] ..... F21V 8/06
(52) U.S. Cl. ..... 362/404; 362/147
(58) Field of Search ..... 362/145, 147–148, 362/150, 374–375, 404–406

(56) References Cited

U.S. PATENT DOCUMENTS

| | | | | | |
|---|---|---|---|---|---|
| 258,587 | A | | 5/1882 | Maschmeyer | |
| 273,420 | A | * | 3/1883 | Wooding | 362/434 |
| 401,934 | A | | 4/1889 | D'Humy | |
| D73,675 | S | | 8/1927 | Solomon | |
| 1,746,339 | A | | 2/1930 | Doane | |
| 2,513,565 | A | * | 7/1950 | Johnson | 362/332 |
| 2,802,933 | A | * | 8/1957 | Broadwin | 362/366 |
| 3,130,949 | A | * | 4/1964 | Wolff et al. | 248/343 |
| 3,321,622 | A | * | 5/1967 | Wellhofer et al. | 362/434 |
| 3,701,897 | A | * | 10/1972 | Pennington et al. | 362/278 |
| 3,943,353 | A | * | 3/1976 | Tada | 362/404 |
| 4,274,615 | A | | 6/1981 | Chan et al. | |
| 4,475,147 | A | | 10/1984 | Kristofek | |
| 4,520,435 | A | * | 5/1985 | Baldwin | 362/311 |
| 5,031,084 | A | * | 7/1991 | Russo et al. | 362/365 |
| 5,181,777 | A | * | 1/1993 | Segill et al. | 362/405 |
| 5,222,800 | A | * | 6/1993 | Chan et al. | 362/147 |
| 5,548,499 | A | * | 8/1996 | Zadeh | 362/366 |
| 5,567,046 | A | * | 10/1996 | Lucas | 362/405 |
| 5,906,430 | A | * | 5/1999 | Bayer | 362/404 |
| 5,909,955 | A | | 6/1999 | Roorda | |
| 5,957,572 | A | * | 9/1999 | Wedekind et al. | 362/365 |
| D427,368 | S | * | 6/2000 | Kelmelis et al. | D26/152 |
| 6,247,832 | B1 | | 6/2001 | Neustadt | |
| 6,416,205 | B2 | * | 7/2002 | Uedono | 362/376 |
| 6,474,846 | B1 | * | 11/2002 | Kelmelis et al. | 362/365 |
| 6,632,006 | B1 | * | 10/2003 | Rippel et al. | 362/366 |
| 2003/0063470 | A1 | | 4/2003 | Grajetzky et al. | |
| 2004/0141328 | A1 | * | 7/2004 | Stone et al. | 362/405 |

* cited by examiner

*Primary Examiner*—Stephen Husar
*Assistant Examiner*—Jason Han
(74) *Attorney, Agent, or Firm*—Thomas R. Lampe

(57) ABSTRACT

A decorative pendant depends from a support ring surrounding a ceiling light fixture flange and extends downwardly from and surrounds the flange to enhance the appearance of the ceiling light fixture.

11 Claims, 2 Drawing Sheets

DECORATIVE LIGHTING SYSTEM

TECHNICAL FIELD

This invention relates to a decorative lighting system and more particularly to lighting apparatus including a ceiling light fixture and an accessory extending downwardly from the ceiling light fixture to enhance the appearance thereof.

BACKGROUND ART

Ceiling light fixtures are well known and the prior art encompasses many different styles and types of such fixtures.

One type of ceiling light fixture in common usage is of a multi-component nature, incorporating a housing for accommodating an electric lamp projecting upwardly from a ceiling and secured relative to the ceiling above an opening in the ceiling and a second selectively removable component having one portion thereof connected to the housing and a radially outwardly extending flange disposed below the ceiling.

The following U.S. patents disclose various representative types of ceiling and other light fixtures: U.S. Pat. No. 6,416,205, issued Jul. 9, 2002, U.S. Pat. No. 4,520,435, issued May 28, 1985, U.S. patent application Publication No. U.S. 2003/0063470 A1, Pub. date Apr. 3, 2003, U.S. Pat. No. 273,420, issued Mar. 6, 1883, U.S. Pat. No. 1,746,339, issued Feb. 11, 1930, U.S. Pat. No. 258,587, issued May 30, 1882, U.S. Pat. No. 5,548,499, issued Aug. 20, 1996, U.S. Pat. No. 6,247,832, issued Jun. 19, 2001, U.S. Pat. No. 4,274,615, issued Jun. 23, 1981, U.S. Pat. No. 4,475,147, issued Oct. 2, 1984, U.S. Pat. No. 5,909,955, issued Jun. 8, 1999, U.S. Pat. No. 401,934, issued Apr. 23, 1889, U.S. Pat. No. 5,567,046, issued Oct. 22, 1996, U.S. Pat. No. 5,181,777, issued Jan. 26, 1993, U.S. Design Pat. No. 73,675, issued Oct. 18, 1927 and U.S. Design Pat. No. 427,368, issued Jun. 27, 2000.

The patents do not teach or suggest the combination of structural elements disclosed and claimed herein including a ceiling light structure of a certain construction and an accessory cooperating with the ceiling light fixture in a unique manner to enhance the appearance of the ceiling light fixture and affect the light produced thereby.

DISCLOSURE OF INVENTION

The present invention relates to lighting apparatus incorporating a ceiling light fixture of known construction in combination with an accessory extending downwardly from the ceiling light fixture to enhance the appearance thereof. The accessory can quickly and readily be applied to or removed from the ceiling light fixture. Utilizing the teachings of this invention a wide variety of decorative affects may be attained. The accessory allows the ambiance and aesthetics of a room to be modified due to the character of the accessory.

The lighting apparatus includes a ceiling light fixture including a first light fixture component comprising a housing for accommodating an electric lamp projecting upwardly from a ceiling and secured in place relative to the ceiling above an opening in the ceiling. The ceiling light fixture also includes a second light fixture component releasably connected to the first light fixture component. The second light fixture component has a first portion connected to the housing and a second portion comprising a flange radially extending outwardly from the first portion and disposed below the ceiling.

The lighting apparatus additionally comprises an accessory extending downwardly from the ceiling light fixture to enhance the appearance of the ceiling light fixture. The accessory includes a support member at least partially disposed between the ceiling and the flange and surrounding the first portion of the second light fixture component. The accessory additionally includes a decorative pendant connected to and depending from the support member and surrounding the flange. The decorative pendant may include a plurality of translucent elements for transmitting and modifying the character of light produced by an electric lamp in the ceiling light fixture.

Other features, advantages and objects of the present invention will become apparent with reference to the following description and accompanying drawings.

MODES FOR CARRYING OUT THE INVENTION

Figure 1:
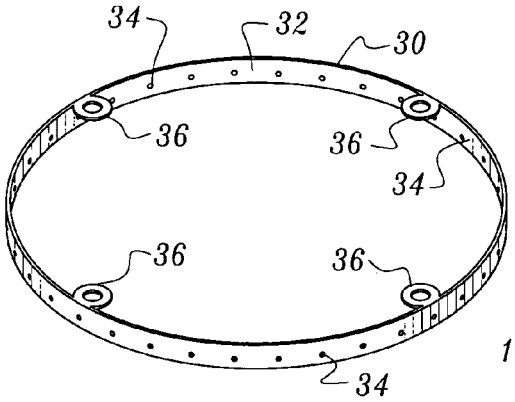
FIG. 1 is a perspective view of a support ring incorporated in the lighting apparatus of the invention.

Referring to FIGS. 1–8, an embodiment of the invention is illustrated. The apparatus of the present invention, as indicated above, relates to a combination of a ceiling light fixture and an accessory extending downwardly from the ceiling light fixture to enhance the appearance of the ceiling light fixture and affect the light produced thereby.

A conventional ceiling light fixture of a type suitably employed in the invention is designated by reference numeral 10. The ceiling light fixture includes a first light fixture component in the form of a housing 12 for accommodating a conventional electric lamp, such as flood lamp (not shown). The housing 12 projects upwardly from ceiling 14 and is secured in place in any suitable manner relative to the ceiling above an opening 16 in the ceiling.

Figure 4:
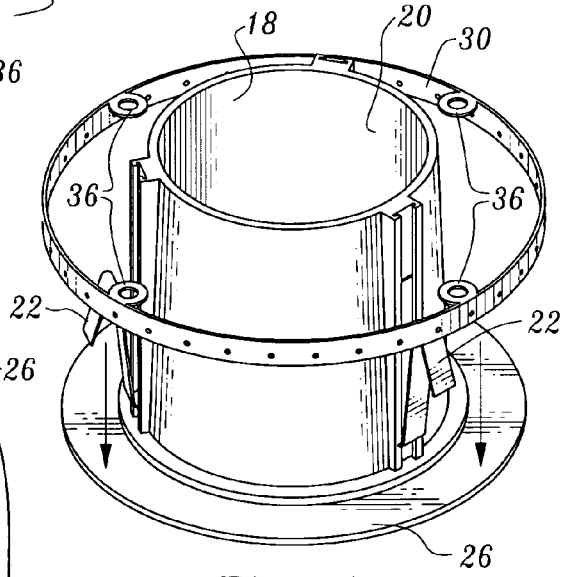
FIG. 4 is a perspective view illustrating installation of the support ring on the ceiling light fixture portion including the flange, in this instance such component having been completely removed from the housing.

As is also conventional, the ceiling light fixture includes a second light fixture component 18. Component 18 has a cylindrically-shaped portion 20 selectively connectable to the housing 12 by connector clips 22 of a well known type and a flange 26 radially extending outwardly from portion 20. By manually manipulating the connector clips 22, an individual can disconnect light fixture component 18 from housing 12. FIG. 4 shows the light fixture component 18 completely removed from the housing. As indicated above, the ceiling light fixture per se is of well known construction, however, with respect to this invention, it is part of a novel construction also including an accessory extending downwardly from the ceiling light fixture to enhance the appearance of the ceiling light fixture.

The accessory includes a support member or ring 30 which is formed of metal, plastic or any other suitable material. The support ring 30 includes a circular-shaped ring wall 32 having a circular inner wall surface defining a round ring opening. The ring wall defines a plurality of spaced holes or openings 34 over the full length of the wall. A plurality of projections 36, also having openings therein, project inwardly from the ring wall 32.

In use, the support ring 30 is positioned manually so that the projections 36 are disposed above the flange. The flange can be utilized to provide support for the support ring and a pendant (described below) depending from the support ring.

Figure 5:
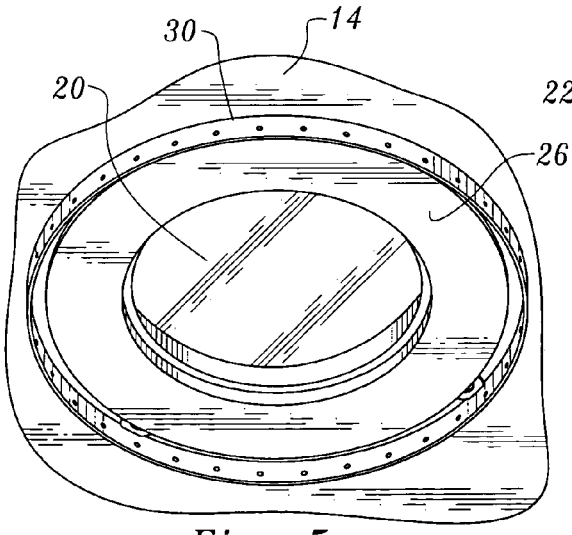
FIG. 5 is a perspective view of the light fixture component incorporating the flange in its normal position relative to the ceiling and housing with projections of the support ring engaging the top of the flange and a ring wall surrounding the flange and extending downwardly therefrom.

Installation can be accomplished in several ways. The light fixture component 18 can, if desired, be completely removed from the housing 12 and the ring inserted from the top as shown in FIG. 4, downward movement of the ring terminating when the bottom or flange engagement surfaces of the projections 36 engage the upper surface of the flange. The light fixture component 18 can then be reconnected to the housing 12 so that the projections are disposed between the ceiling and flange and the ring wall 32 surrounds the flange and extends downwardly therefrom as shown in FIG. 5.

Figure 2:
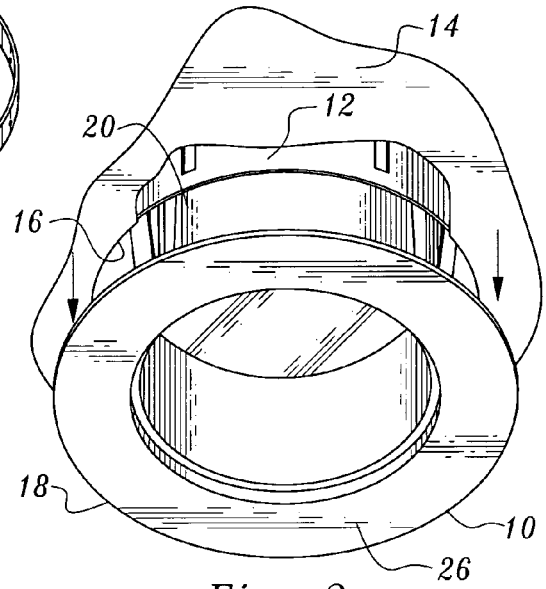
FIG. 2 is a perspective view illustrating a ceiling light fixture of the type employed in the present invention and illustrating removal of one of the components thereof incorporating a flange from the other component thereof comprising a housing.
Figure 3:
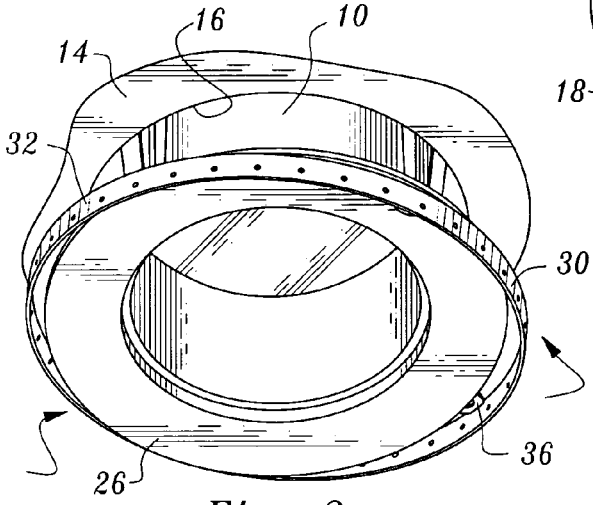
FIG. 3 is a perspective view illustrating positioning of the support ring on the flange after the flange has been pulled from its normal position closely adjacent to the ceiling.

Another alternative approach to installation of the support ring is to only partially disengage the light fixture component 18 from housing 12 to provide a gap between the flange 26 thereof and the ceiling. This is shown in FIGS. 2 and 3. FIG. 3 also shows the support ring being tilted and positioned relative to the flange in such a manner that the projections 36 clear the flange and are disposed thereabove. This is possible due the fact that the flange has a circular outer peripheral diameter less than the diameter of the circular inner wall surface of the ring wall and further due to the fact that the projections are spaced and sized so that they will not interfere with installation.

Figure 6:
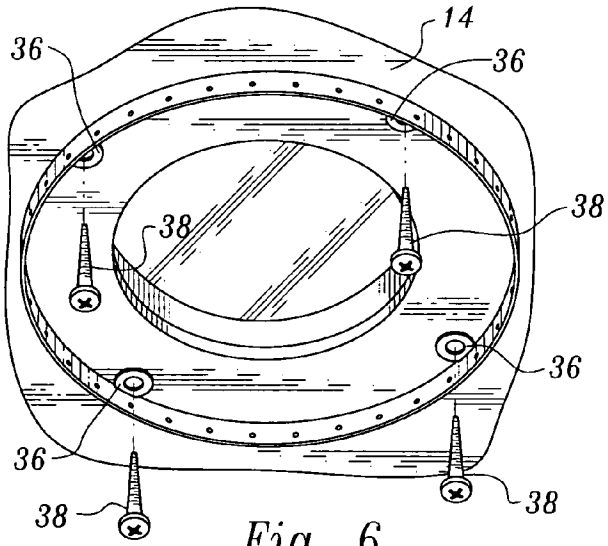
FIG. 6 is a perspective view illustrating an alternative approach of attaching the support ring, in this instance directly to the ceiling.

FIG. 6 shows another approach to installing the support ring 30. In this approach, the ring is brought into engagement with the ceiling 14 and mechanical fasteners such as screws 38 are introduced into the openings in projections 36 and screwed into the ceiling to maintain the support ring in place. The flange of the light fixture component 18 need not be employed to support the support ring. This approach allows use of the accessory with ceiling light fixtures which do not employ flanges large enough to engage and support the projections 36.

Figure 7:
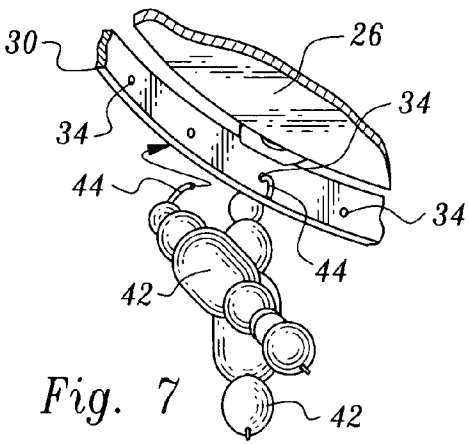
FIG. 7 is an enlarged view in partial cross-section illustrating a portion of the flange and a portion of the support ring in the condition thereof illustrated in FIG. 5, and further illustrating attachment of elongated bead strings comprising portions of a decorative pendant to the support ring.

The accessory also includes a skirt-like decorative pendant 40 (FIG. 8) which is connected to and depends from the support ring and surrounds flange 26. The decorative pendant includes a plurality of pendant elements in the form of bead strings 42 which are connected at the upper ends thereof to the support ring. As is shown in FIG. 7, each bead string 42 has a hook 44 at the upper end thereof. The hooks are positioned in openings 34 to provide an inner connection between the bead string components of the decorative skirt-like pendant and the support ring. It will be appreciated that the decorative pendant will affect light produced by an electric lamp (not shown) in the ceiling light fixture to produce a pleasing effect and also enhance the appearance of the ceiling light fixture. Suitably, for example, at least some of the beads in some of the elongated bead strings are translucent and perhaps of different colors.

The shape and style of the pendant 40 is exemplary only, it being understood that other types and forms of pendants may be employed and still fall within the teachings of the present invention.

Figure 9:
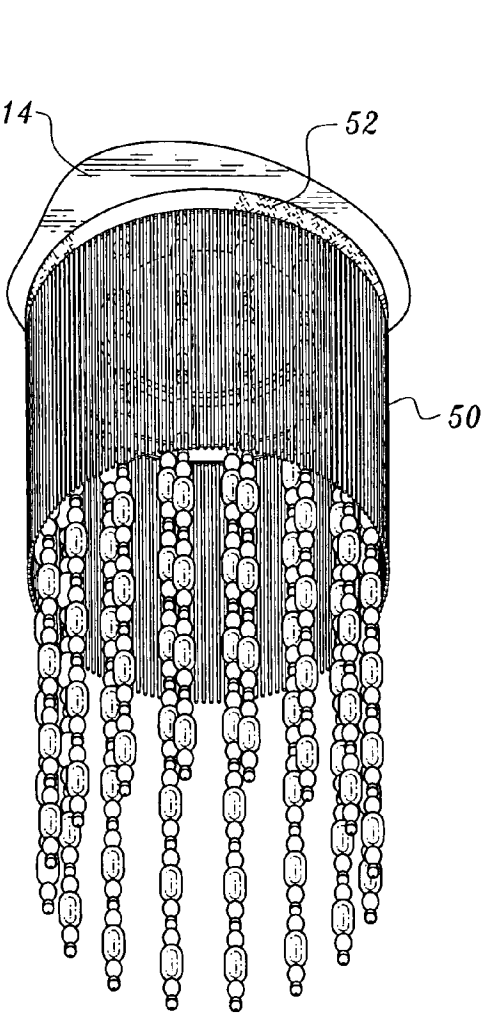
FIG. 9 is a view similar to FIG. 8, illustrating an alternative embodiment of the invention.
Figure 8:
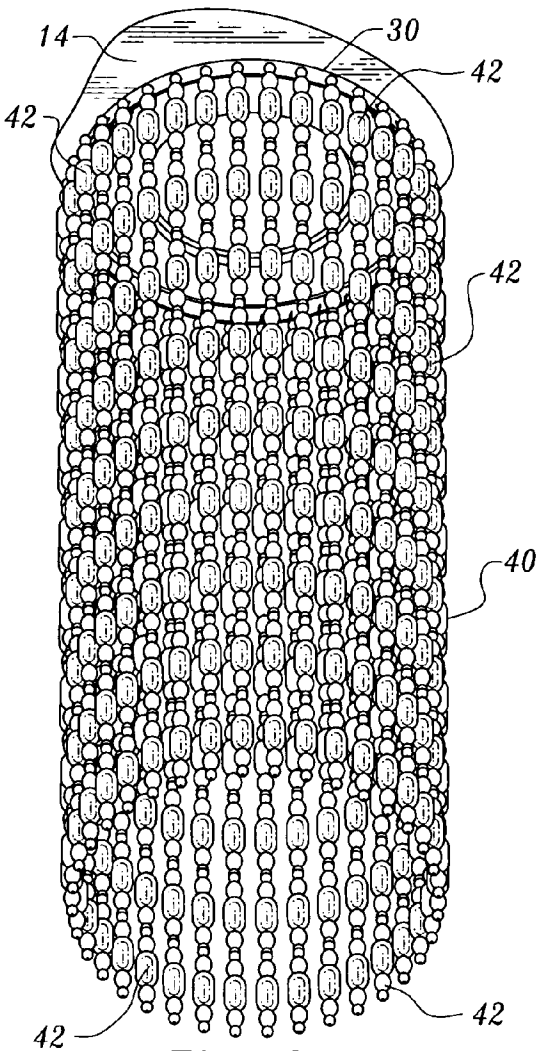
FIG. 8 is a perspective view illustrating the lighting apparatus of the present invention fully assembled.

FIG. 9 shows a different representative style of pendant, pendant 50. In addition, in this embodiment the elongated pendant elements or bead strings are affixed to a band 52, which may be formed of fabric or other suitable material which extends about the outer periphery of the support ring. The band may be secured to the ring in any desired fashion, for example adhesive or by sewing the band in place.

What is claimed is:

1. Lighting apparatus comprising, in combination:

a ceiling light fixture including a first light fixture component comprising a housing for accommodating an electric lamp projecting upwardly from a ceiling and secured in place relative to the ceiling above an opening in the ceiling and a second light fixture component releasably connected to the first light fixture component, said second light fixture component having a first portion connected to the housing and a second portion comprising a flange radially extending outwardly from said first portion and disposed below the ceiling; and an accessory extending downwardly from said ceiling light fixture to enhance the appearance of the ceiling light fixture, said accessory including a support member at least partially disposed between said ceiling and said flange and surrounding the first portion of said second light fixture component and a decorative pendant connected to and depending from said support member and surrounding said flange, said decorative pendant including a plurality of pendant elements for affecting light produced by an electric lamp in the ceiling light fixture.

2. The lighting apparatus according to claim 1 wherein said support member comprises a support ring having a ring wall from which said pendant elements depend.

3. The lighting apparatus according to claim 1 wherein said decorative pendant has a skirt-like configuration.

4. The lighting apparatus according to claim 2 wherein said decorative pendant further includes a band extending around said support ring and secured to said support ring, said plurality of pendant elements attached to said band and depending therefrom.

5. The lighting apparatus according to claim 2 wherein said ring wall has a circular inner wall surface defining a round ring opening and wherein said flange has a circular outer periphery, said circular inner wall surface of said ring wall having a diameter larger than the diameter of said flange circular outer periphery for facilitating manual positioning of said flange within the confines of said ring wall.

6. The lighting apparatus according to claim 2 wherein said support member additionally comprises a plurality of projections projecting inwardly from said ring wall and positioned on and in engagement with said flange.

7. The lighting apparatus according to claim 6 wherein said projections define holes for receiving mechanical fasteners for fastening said support ring to a ceiling.

8. The lighting apparatus according to claim 6 wherein said projections have flange engagement surfaces engaging an upper surface of said flange whereby said support member is at least partially supported by said flange.

9. The lighting apparatus according to claim 2 wherein said ring wall defines a plurality of spaced openings, said decorative pendent further including connectors connecting said decorative pendant to said support ring.

10. The lighting apparatus according to claim 9 wherein said pendant elements comprise elongated bead strings.

11. The lighting apparatus according to claim 10 wherein at least some of the beads in said elongated bead strings are translucent.

* * * * *